US006955632B2

(12) United States Patent
Wang et al.

(10) Patent No.: US 6,955,632 B2
(45) Date of Patent: Oct. 18, 2005

(54) OVAL-TRACKED EXERCISE APPARATUS FOR SIMULATING HAND-MOVEMENT

(76) Inventors: Leao Wang, No. 1, Lane 233, Sec. 2, Charng Long Rd., Taiping (TW) 411; Peter Wu, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 10/779,957

(22) Filed: Feb. 17, 2004

(65) Prior Publication Data

US 2005/0181910 A1 Aug. 18, 2005

(51) Int. Cl.[7] ..... A63B 22/04; A63B 22/00
(52) U.S. Cl. ..... 482/52; 482/57
(58) Field of Search ..... 482/51, 52, 57, 482/70, 79–80

(56) References Cited

U.S. PATENT DOCUMENTS 6,083,143 A * 7/2000 Maresh ..... 482/57
6,090,013 A * 7/2000 Eschenbach ..... 482/52
6,090,014 A * 7/2000 Eschenbach ..... 482/52
6,422,976 B1 * 7/2002 Eschenbach ..... 482/52
6,422,977 B1 * 7/2002 Eschenbach ..... 482/52
6,436,007 B1 * 8/2002 Eschenbach ..... 482/52
6,440,042 B2 * 8/2002 Eschenbach ..... 482/52

* cited by examiner

*Primary Examiner*—Stephen R. Crow
(74) *Attorney, Agent, or Firm*—Troxell Law Office, PLLC

(57) ABSTRACT

The invention relates to an oval-tracked exercise apparatus for simulating hand-movement having two rocker arms and two treadle bars. The bottom end of the rocker arms and the front end of the treadle bars are joined to each other by a pivot. The rear end of the treadle bars is pivotally connected to the side of a rotary body. Both of the treadle bars are movable up and down in an offset position for simulating the movement of hands and feet in an oval track during exercise session. An adjusting mechanism is provided to adjust the angle of the connecting mechanism for simulating a walking exercise on an uphill road or on a downhill road.

3 Claims, 6 Drawing Sheets

OVAL-TRACKED EXERCISE APPARATUS FOR SIMULATING HAND-MOVEMENT

BACKGROUND OF THE INVENTION

1. Fields of the Invention

The invention relates to an oval-tracked exercise apparatus for simulating hand-movement, and more particularly, to an apparatus for simulating the actual motion of the hands and the feet in an oval track during walking exercise session.

2. Description of the Related Art

People work for what they need. Meanwhile, they realize how important their health is. Therefore, they do exercise for keeping their bodies in good condition. The simplest way to exercise is the use of the exercise apparatuses.

Among the exercise apparatuses, the oval-tracked exercise apparatus can best simulate the actual walking exercise. U.S. Pat. No. 3,315,898 ("Rehabilitation & Exercise Apparatus") teaches that a motor imparts motion to two treadle bars through a belt-driven toothed plate such that the treadle bars move in an offset position. However, it lacks means for keeping the body in balance. Therefore, the operator easily falls from the exercise apparatus due to the instability of his center of gravity.

Another prior art—U.S. Pat. No. 5,242,343 ("Stationary Exercise Device")—teaches that two rocker arms are pivotably connected to the base. The bottom of each rocker arm and the front end of the treadle bars are joined to each other in a movable state. The other end of the treadle bars is attached to the side of the flywheel. Both of the treadles are alternatingly treaded to simulate the movement of hands and feet in an oval track. Meanwhile, both rocker arms move in alternating way to aid the operator in keeping their bodies in balance.

Since the hands of the operators are synchronically movable with the rocker arms to perform the arched, reciprocating motion, this doesn't correspond to the actual coordinating movement of hands and feet during walking session. Due to the non-ergonomic design, the muscle function could be deteriorated, thereby causing the abnormality of the balance sense.

SUMMARY OF THE INVENTION

In light of the demerits of the prior art, the invention provides an oval-tracked exercise apparatus for simulating hand-movement that aims to ameliorate at least some of the disadvantages of the prior art and to provide a useful alternative.

A primary objective of the invention is to provide an oval-tracked exercise apparatus for simulating hand-movement having two rocker arms and two treadle bars. The bottom end of the rocker arms and the front end of the treadle bars are joined to each other by a pivot. The rear end of the treadle bars is pivotally connected to the side of a rotary body. Both of the treadle bars are movable up and down in an offset position for simulating the movement of hands and feet in an oval track during exercise session. An adjusting mechanism is provided to adjust the angle of the connecting mechanism for simulating a walking exercise on an uphill road or on a downhill road.

Another object of the invention is to enable all of the operator's extremities to locate on the exercise apparatus.

A further object of the invention is to enable the hands of the operators to move in accordance with the movement of their feet in an oval track such that the operator's health can be improved.

Still another object of the invention is to provide an adjusting mechanism to adjust the angle of the treadle bars for simulating a walking exercise on an uphill road or on a downhill road.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
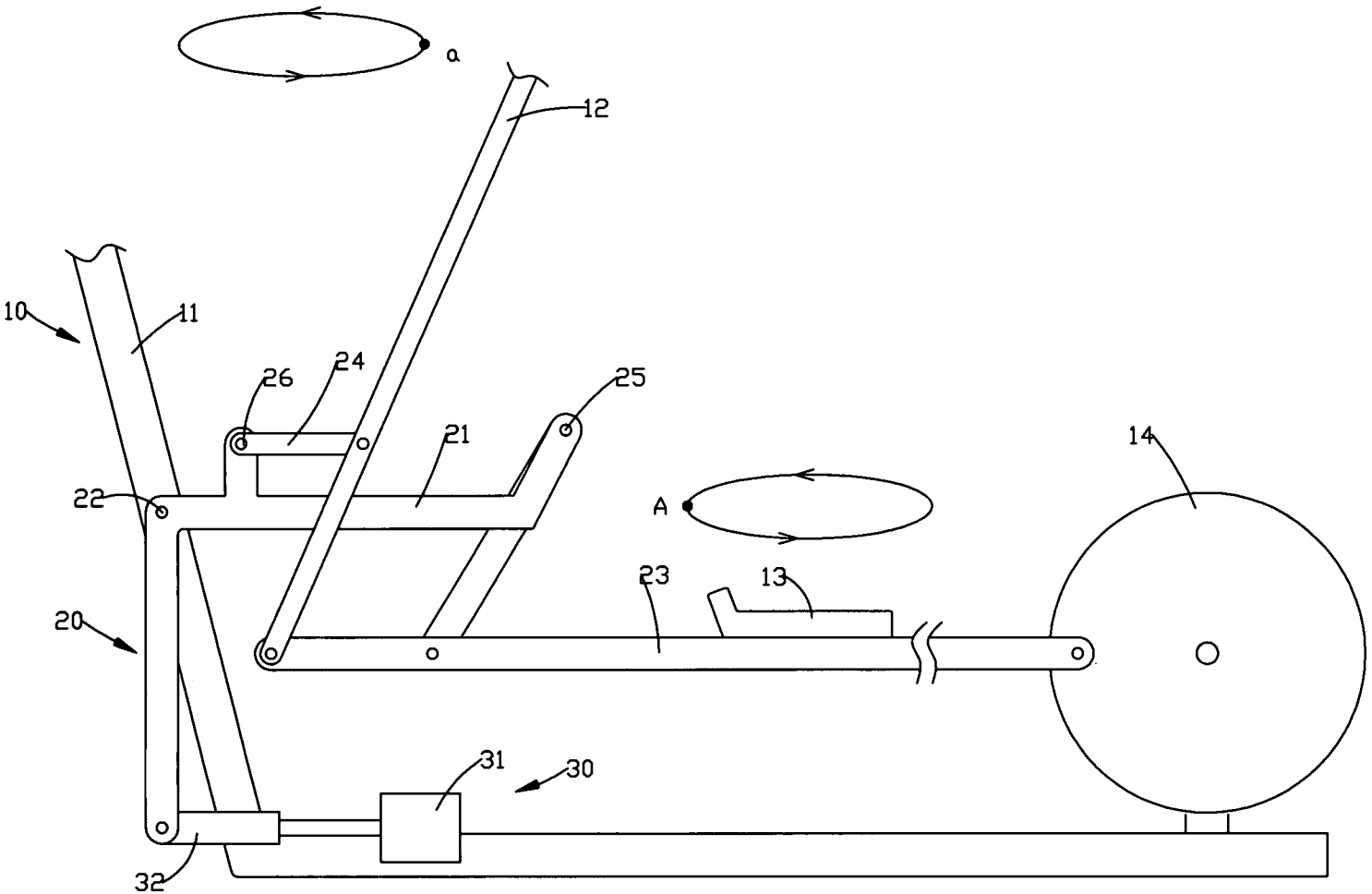
FIG. 1 is a schematic drawing of the invention with the coupled relationship among the connecting mechanism, the treadle bar and the rocker arm.
Figure 2:
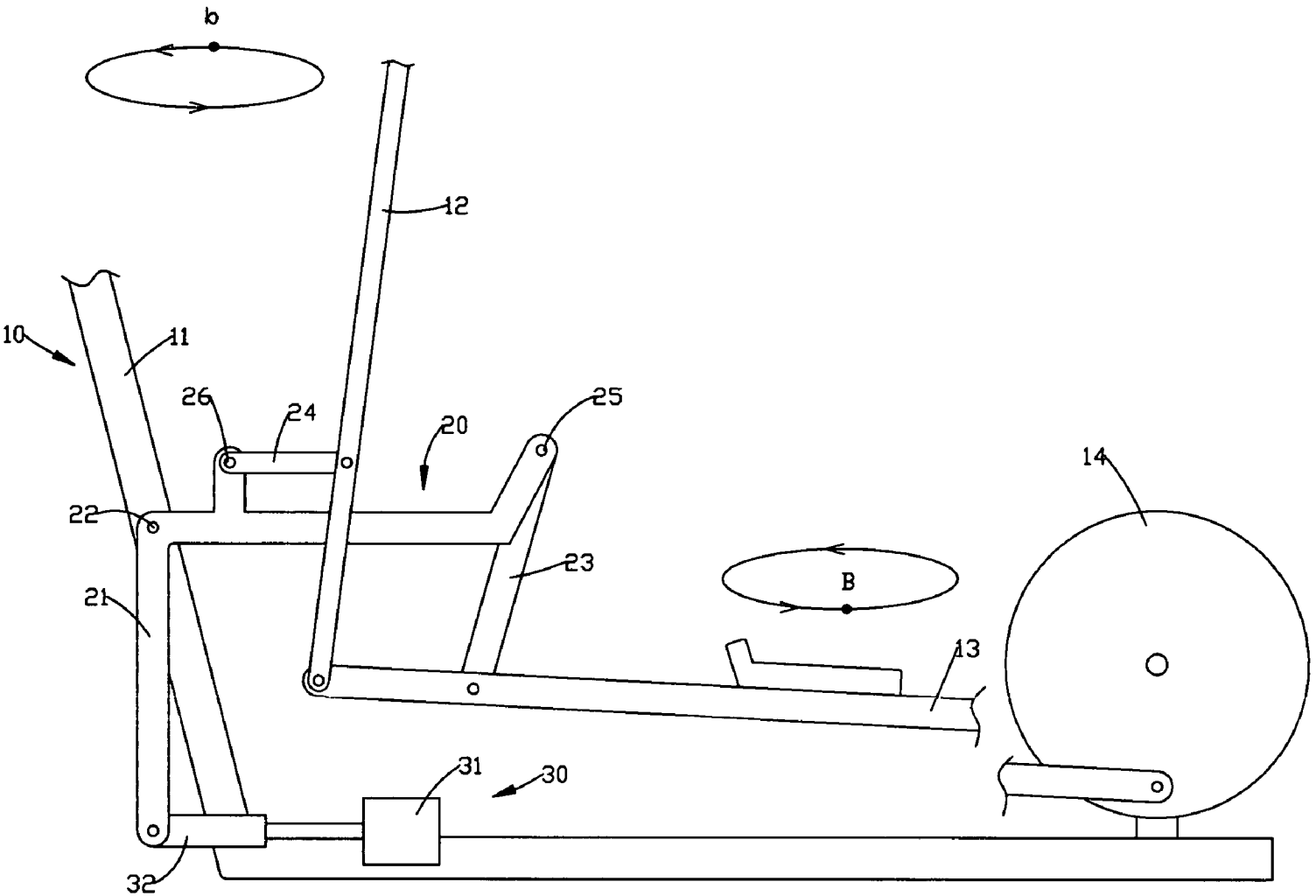
FIG. 2 is a schematic drawing of the invention with the coupled relationship among the connecting mechanism, the treadle bar and the rocker arm in a first operation position when the rotary body rotates.
Figure 3:
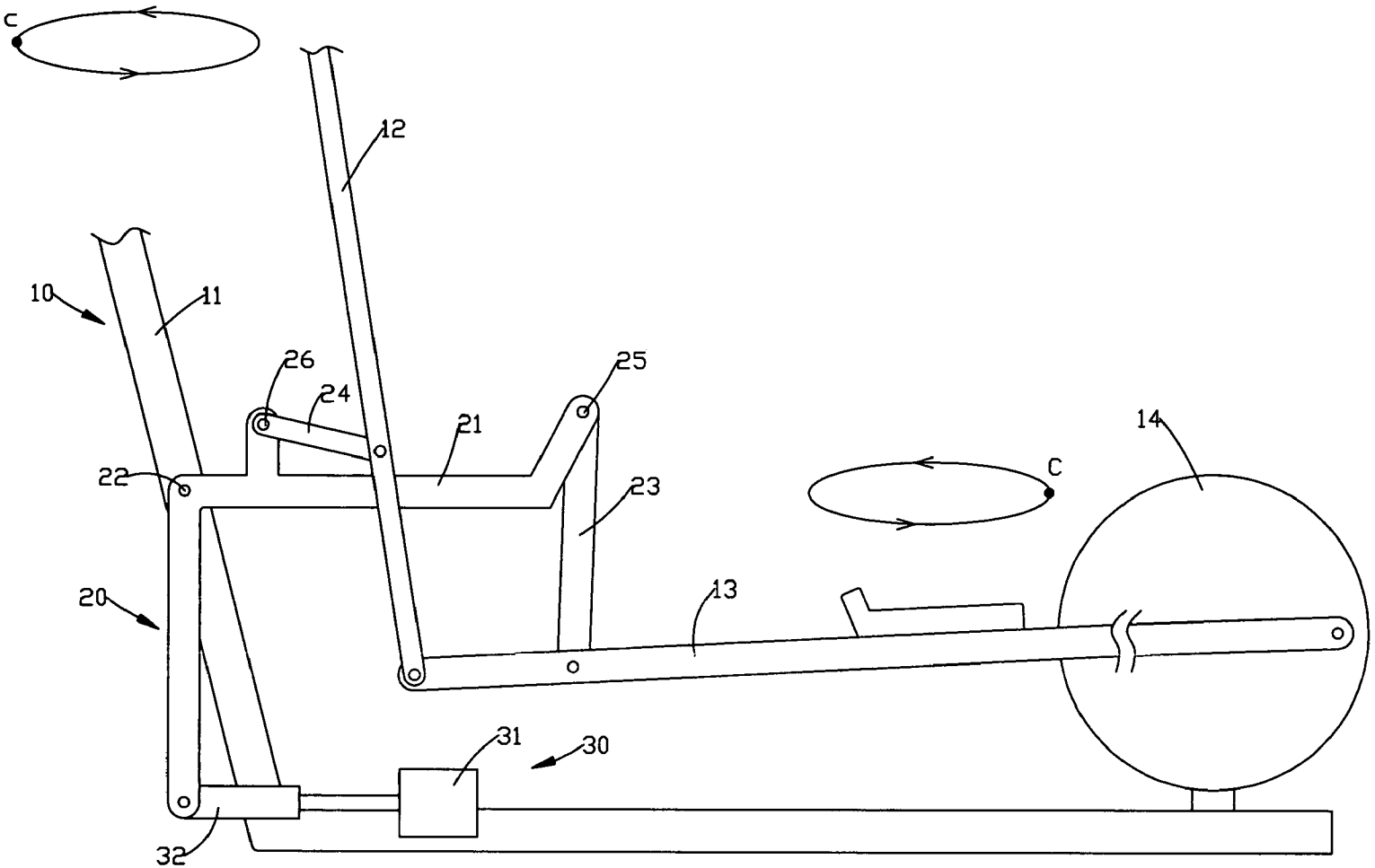
FIG. 3 is a schematic drawing of the invention with the coupled relationship among the connecting mechanism, the treadle bar and the rocker arm in a second operation position when the rotary body rotates.
Figure 4:
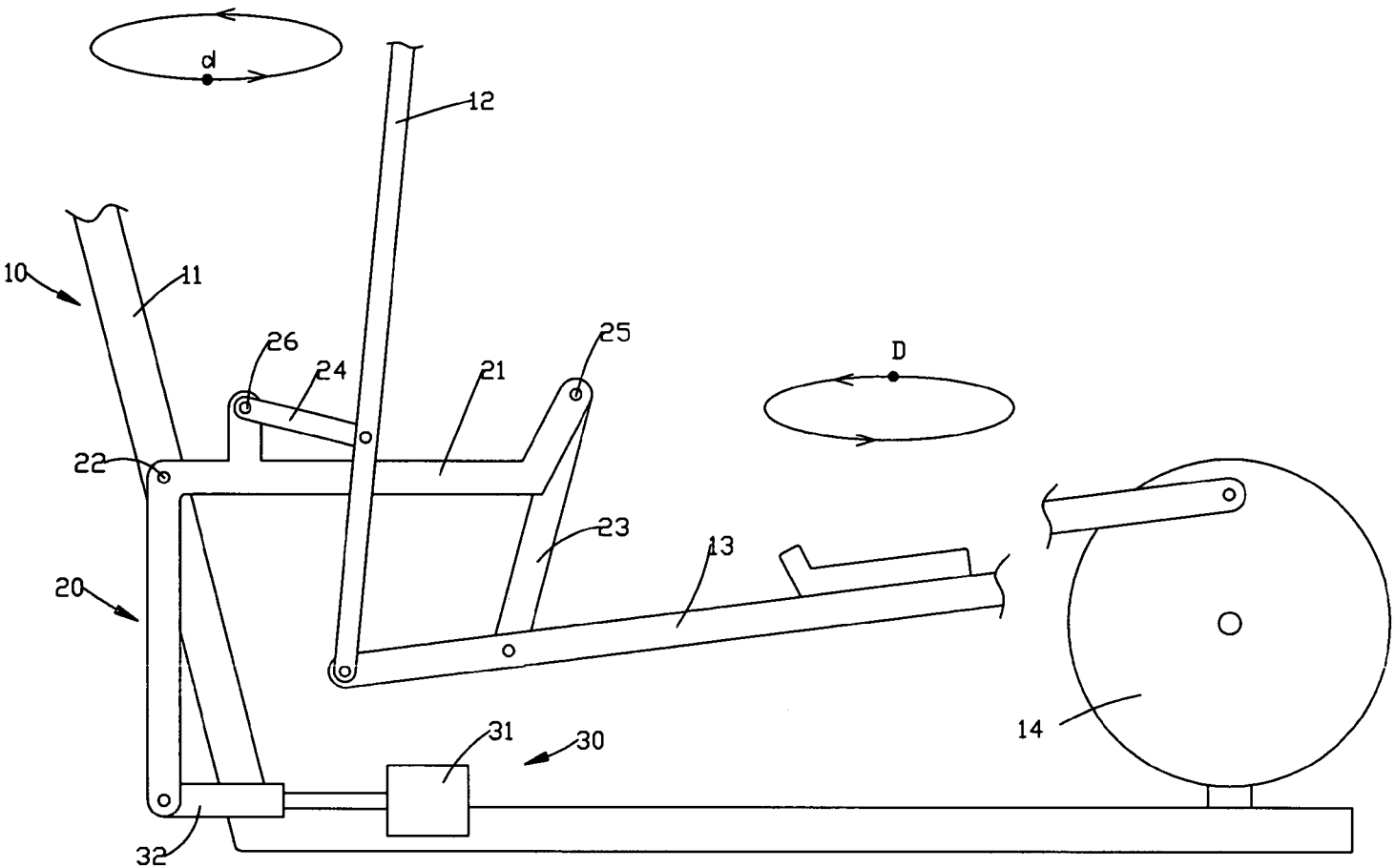
FIG. 4 is a schematic drawing of the invention with the coupled relationship among the connecting mechanism, the treadle bar and the rocker arm in a third operation position when the rotary body rotates.

The conventional oval-tracked exercise apparatuses are divided into electric and manual type machines. Their constructions are almost the same, but the greatest difference lies in that the electrical oval-tracked exercise apparatus utilizes electric motor to drive the toothed disc in rotation while the manual one is operated by continual action of operator's feet to impart motion to a flywheel thereof. The invention can be applied to both the toothed disc of the electrical oval-tracked exercise apparatus and the flywheel of the manual oval-tracked exercise apparatus. In order to unifying the different terms for them, a rotary body is used hereinafter to stand for these different terms.

Meanwhile, the invention has two sides with the same components that are disposed in a staggered way. In order to prevent the illustration in a mess, they are shown with only one side.

Referring to FIGS. 1 through 4, the main frame 11 is connected with a rocker arm 12 by a connecting mechanism 20. The bottom of the rocker arm 12 is pivotably connected to the front end of a treadle 13 while the rear end of the treadle 13 is pivotably connected to the rotary body 14. Therefore, a cyclic movement along an oval track can be simulated by the oval-tracked exercise apparatus 10 of the invention.

The aforementioned connecting mechanism 20 includes a positioning rod 21 pivotally joined to the rocker arm 12 at a fulcrum 22. The lower end of the positioning rod 21 is connected to an adjusting mechanism 30 consisting of a motor 31 and a driving member 32 while the upper end of the positioning rod 21 is pivotably connected to a first connecting rod 23 at a fulcrum 25. The first connecting rod 23 is then connected to the treadle 13. A second connecting rod 24 pivotably connected near the middle point of the rocker arm 12 is interposed between the first connecting rod 23 and the fulcrum 22.

When the rotary body 14 is driven into rotation, it will impart motion to the treadle 13 and the rocker arm 12 for simulating a synchronous, oval-tracked cyclic movement. This motion corresponds to the coordination action of hands and feet during walking exercise. The operating procedure of the invention is explained as follows:

The distal end of the treadle 13 is shifted with the rotation of the rotary body 14 in a circular path. The treadle bar and the first connecting rod 23 are hinged to each other while the first connecting rod 23 and the positioning rod 21 are joined at the top by a first pivot 25. Then, the treadle bar is cyclically movable along a curve consisting of all points at a distance of the length of the first connecting rod 23 from the first pivot 25 to form an oval track.

Meanwhile, the rocker arm 12 is also movable by the treadle bar since the rocker arm 12 and the treadle bar are hinged to each other at one end. In addition, the rocker arm 12 and the second connecting rod 24 are joined near the middle point of the rocker arm 12 by a second pivot. Therefore, the rocker arm 12 is movable along a curve every point of which is equidistant with the length of the second connecting rod 24 from the second pivot to form another oval track.

As shown in FIG. 1, the positioning rod 21 is fixed by the adjusting mechanism 30 in position. At that time, the treadle 13 is located in a horizontal position. When the user treads with his feet on the treadle 13 or the rotary body 14 is driven by an electric motor in rotation, the treadle 13 will be shifted to the position B shown in FIG. 2. At that time, the front end of the treadle 13 is raised at a certain angle under restriction of the first connecting rod 23. Meanwhile, the rocker arm 12 pivoted at the front end of the treadle bar is shifted to the upper position b (see FIG. 2) by use of the second connecting rod 24. When the rotary body 14 is driven in rotation by another treadle 13 (not shown) or external force, the treadle 13 will be shifted to the left position C (see FIG. 3). Under the restriction of the first connecting rod 23, the front end of the treadle 13 is lowered at an angle for swinging the rocker arm 12 together with second connecting rod 24 to the right position c (see FIG. 3). When the treadle 13 travels to the upper position D (see FIG. 4) and then returns to its original position A in FIG. 1, an oval track is completed. The rocker arm 12 is shifted from the position d back to the position a by use of the second connecting rod 24. Both of them create an oval-shaped track and correspond to each other for simulating the treading action of the feet and the swinging action of the hands during the walking, jogging or running sessions.

Figure 5:
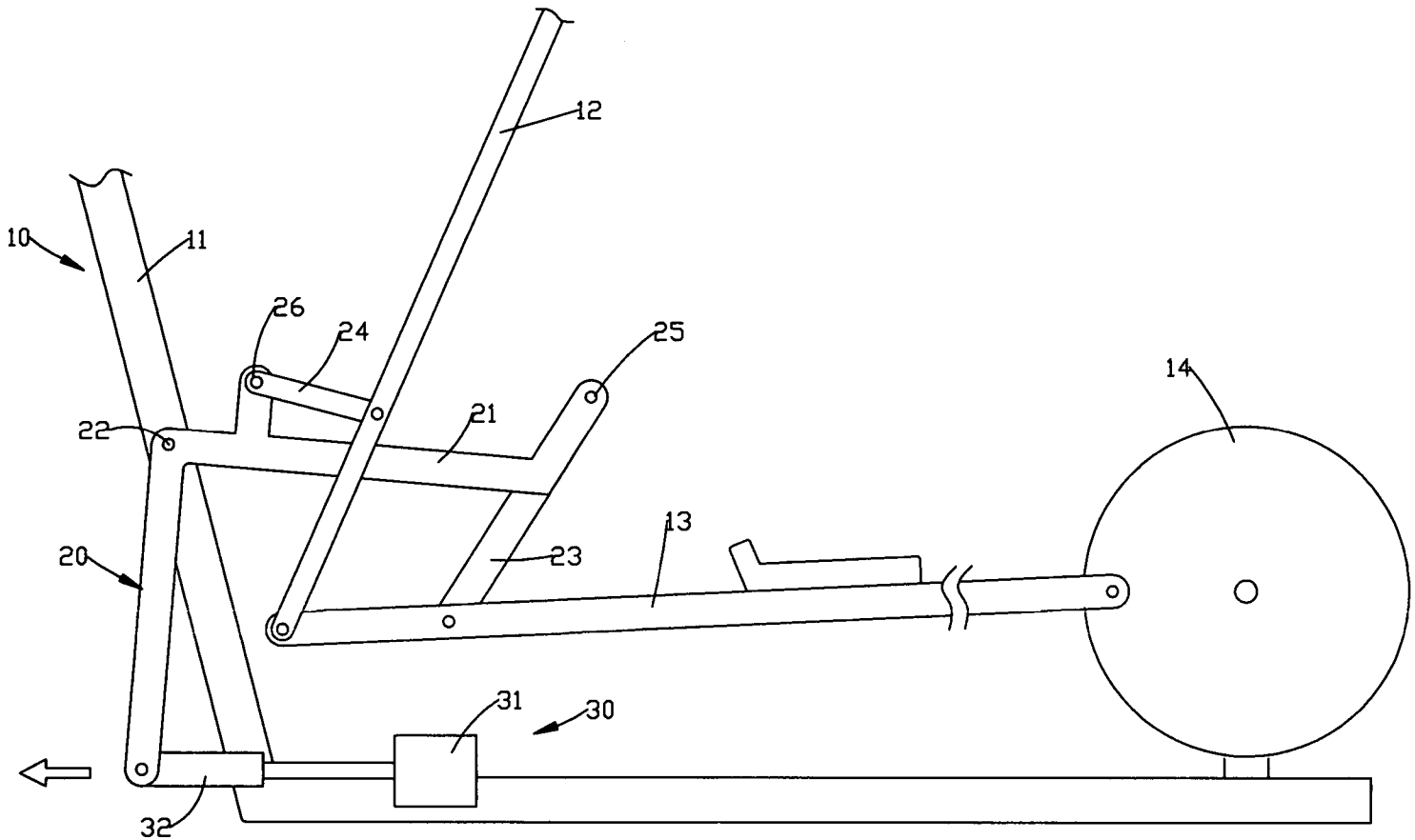
FIG. 5 is a schematic drawing of the invention with the adjusting mechanism in an extended position.
Figure 6:
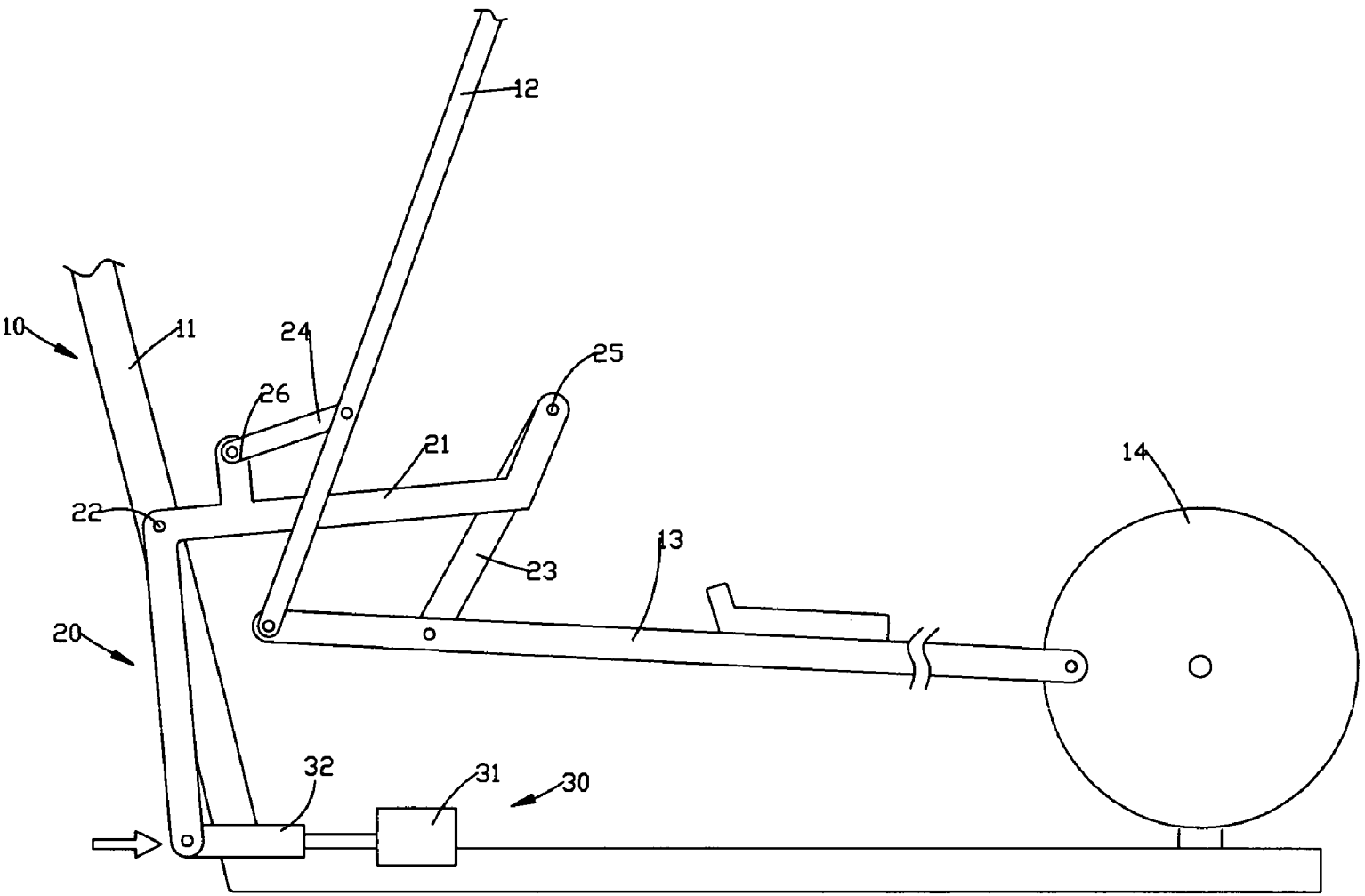
FIG. 6 is a schematic drawing of the invention with the adjusting mechanism in a retracted position.

FIGS. 5 and 6 show the extending and retracting movement of the adjusting mechanism 30. The positioning rod 21 is adjustable to a desire angle by the adjusting mechanism 30 for directly changing the relative position of the components of the connecting mechanism 20 and indirectly changing the angle of the treadle 13 and the rocker arm 12. As shown in FIG. 6, when the adjusting mechanism 30 retracts the positioning rod 21 of the connecting mechanism 20, the treadle 13 together with the rocker arm 12 is raised to a certain extent under restriction of the two connecting rods 23, 24. This can be used to simulate a walking exercise on an uphill road. To the contrary, as shown in FIG. 5, when the adjusting mechanism 30 is extended outwardly, the rocker arm 12 is lowered by the action of the two connecting rods 23, 24. Therefore, the treadle 13 between the rocker arm 12 and the rotary body 14 can be used to simulate a walking exercise on a flat road. If the adjusting mechanism 30 is extended to the outermost position, the treadle 13 can be used to simulate a walking exercise on a downhill road.

In addition, another construction with the same effect can be derived from the above-mentioned design. For example, both treadles 13 are used with two connecting mechanisms 20 each of which is positioned by one adjusting mechanism 30. Alternatively, both of the connecting mechanisms 20 are joined by a crossbar (not shown) so that only one adjusting mechanism 30 is enough for driving them. Thus, the oval-tracked exercise apparatus of the invention is more practical with optional alternatives.

Besides, the adjusting mechanism 30 can consist of an adjusting rod with several through holes and a fixing bolt for replacing the motor 31 used with the driving member. Therefore, operators can choose electrical or manual adjustment mode in accordance with their own preference.

Therefore, the advantages of the invention can be concluded as follows:

1. The use of the oval-tracked exercise apparatus of the invention simulates the movement of the hands and the feet during the session of walking exercise, unlike that the conventional rocker arms can only perform single arched swing.
2. The simulation of the movement of the hands and the feet in walking exercise will enable the feet to move in an oval track for keeping the operator's health in good condition.
3. The uphill and downhill exercise modes are available by adjusting the adjusting mechanism of the invention.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An oval-tracking exercise apparatus comprising:

a) a main frame;

b) a rotary body rotatably connected to a first end of the main frame;

c) two treadle bars, each of the two treadle bars is pivotally connected at a first end thereof to one of two opposing sides of the rotary body;

d) two rocker arms, each of the two rocker arms is pivotally connected at an end thereof to a second end of one of the two treadle bars; and e) a connecting mechanism having:

i) two first connecting rods, each of the two first connecting rods is pivotally connected at a first end thereof to one of the two treadle bars at a position located between one of the two rocker arms and the rotary body;

ii) two second connecting rods, each of the two second connecting rods is pivotally connected to one of the two rocker arms; and iii) two positioning rods, each of the two positioning rods is pivotally connected at a first positioning rod end to a second end one of the two first connecting rods, at a first connecting point to a second end of one of the two second connecting rods, and at a second connection point to a second end of the main frame, the first connecting point and the second connection point are located between the first positioning rod end and a second positioning rod end.

2. The according to claim 1, further comprising an adjusting mechanism pivotally connected at the second positioning rod end of each of the two positioning rods and selectively positioning the two positioning rods and the two treadle bars between a plurality of a predetermined positions.

3. The according to claim 1, wherein the first connecting point of each of the two positioning rods is located between the first positioning rod end and the second connecting point.

* * * * *